United States Patent [19]

Glomeau et al.

[11] Patent Number: 4,741,247

[45] Date of Patent: May 3, 1988

[54] PNEUMATIC ACTUATOR APPARATUS

[75] Inventors: J. Robert Glomeau, Dover; Gareth A. Keith, Sherborn, both of Mass.

[73] Assignee: Rexa Corporation, Dover, Mass.

[21] Appl. No.: 908,177

[22] Filed: Sep. 17, 1986

[51] Int. Cl.[4] ..... F15B 13/16

[52] U.S. Cl. ..... 91/361; 91/459; 60/413

[58] Field of Search ..... 91/361, 459; 60/413, 60/415, 416

[56] References Cited

U.S. PATENT DOCUMENTS

| | | | |
|---|---|---|---|
| 3,538,814 | 11/1970 | Fisher | 91/51 |
| 3,795,110 | 3/1974 | Kobelt | 60/413 |
| 4,077,738 | 3/1978 | Keely et al. | 91/361 X |
| 4,437,385 | 3/1984 | Kramer et al. | 91/361 |
| 4,481,451 | 11/1984 | Kautz et al. | 91/361 X |

*Primary Examiner*—Edward K. Look

*Attorney, Agent, or Firm*—Henry D. Pahl, Jr.

[57] ABSTRACT

The apparatus disclosed herein provides controlled operation of a pneumatic actuator by effecting charging and discharging of the actuator through an intermediate step volume, the pressure in the step volume being regulated as a respective function of the existing pressure in the actuator during charging and discharging.

7 Claims, 3 Drawing Sheets

PNEUMATIC ACTUATOR APPARATUS

BACKGROUND OF THE INVENTION

The present invention relates to apparatus for operating a pneumatic actuator and more particularly to such apparatus which provides direct response to digital electronic controllers.

In general, it has heretofore been relatively difficult to operate pneumatic actuators directly from electric signals as generated by electronic controllers, analog or digital in nature. Accordingly, for applications where such controllers are used it has typically been necessary to utilize complex transducers to convert analog or digital signals to pneumatic signals, a situation that entails higher cost and degradation of the system's precision and dynamic response.

By and large, pneumatic actuators as known heretofore have not been well adapted for use in systems employing electronic controllers. In particular, such previous art actuators have not been suitable for operating directly from digital logic or pulse controllers. Such controllers are experiencing generally increased popularity due to their flexibility and programmability.

Furthermore, most pneumatic actuators and control systems known previously have entailed a constant air bleed whether or not the actuator was producing any movement, a condition detrimental to the actuators's energy efficiency.

Among the several objects of the present invention may be noted the provision of novel apparatus for operating a pneumatic actuator; the provision of such apparatus which facilitates precise control of a pneumatic actuator; the provision of such apparatus which facilitates the use of digital controllers in operating a pneumatic actuator within an overall servo system; the provision of such apparatus which can be operated efficiently and at low cost; the provision of such apparatus which is highly reliable and which is of relatively simple and inexpensive construction. Other objects and features will be in part apparent and in part pointed out hereinafter.

SUMMARY OF THE INVENTION

Briefly, the apparatus of the present invention is adapted to operate a pneumatic actuator from a source of gas under pressure. Means are provided which define a step volume, i.e. a chamber together with associated connecting passages. Valve means are provided for selectively charging the step volume from the source while a differential pressure regulator is provided for venting the step volume during charging to limit the pressure therein as a first predetermined function of the pressure in the actuator. This first regulator provides a step volume pressure which is higher than the cylinder pressure. Second valve means are provided for selectively discharging gas from the step volume with a second differential pressure regulating means being provided for controlling the discharge to limit pressure in the step volume as a second predetermined function of the pressure in the actuator. This second regulator provides a step volume pressure which is lower than the cylinder pressure. A third valve means is provided for selectively connecting the step volume to the actuator. In operating the apparatus, the charging valve and the connecting valve are operated alternately to advance the actuator while, to retract the actuator, the discharge valve and the connecting valve are operated alternately.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
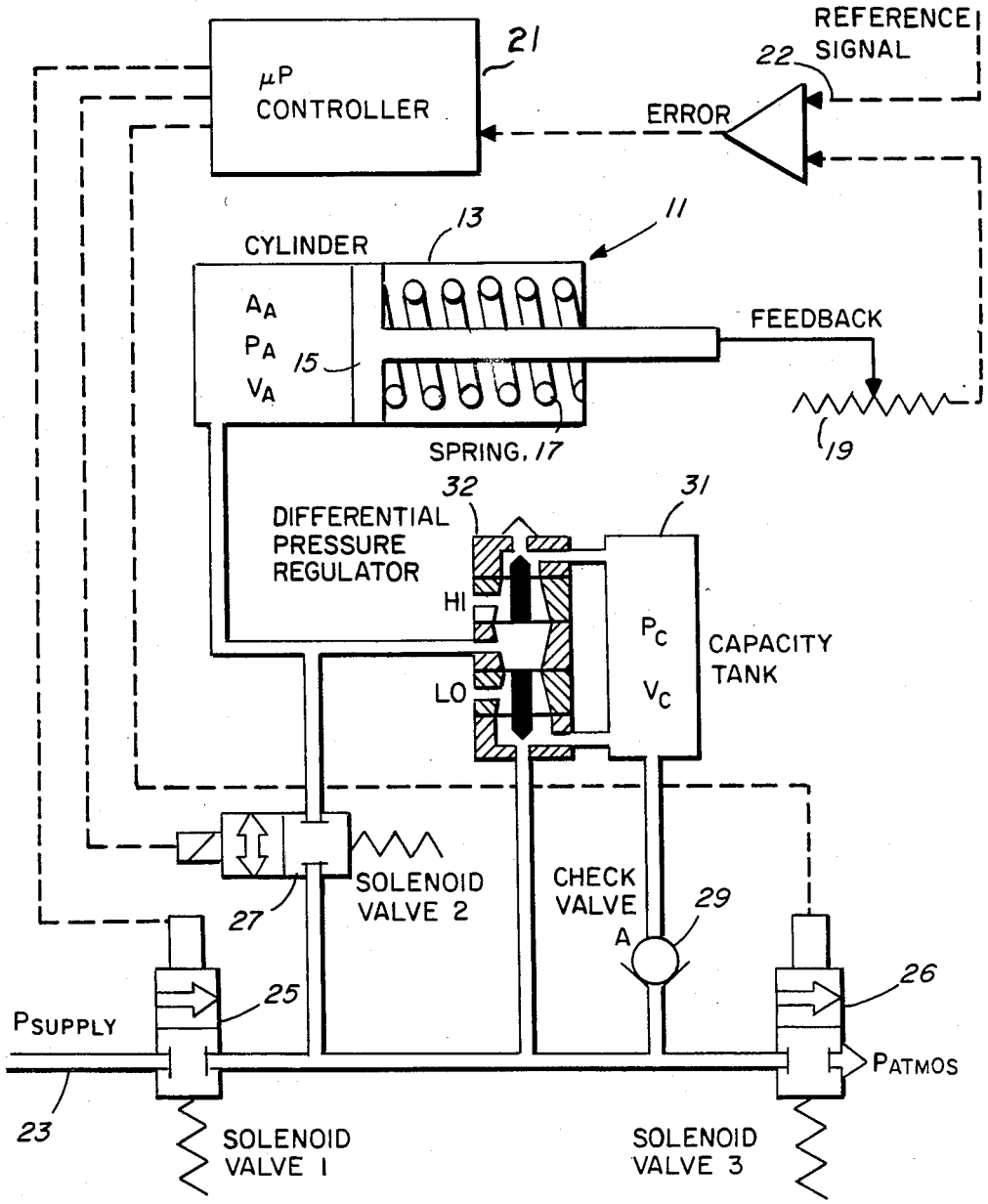
FIG. 1 is a schematic diagram of apparatus for operating a pneumatic actuator in accordance with the present invention.

Referring now to FIG. 1, a pneumatic actuator is indicated generally by reference character 11. Actuator 11 is of the single acting variety comprising a cylinder 13 and a piston 15 with a spring 17 being utilized to provide a restoring force to retract the piston when pressure to the left of the piston is reduced. To facilitate the use of the apparatus in an overall servo system, the piston 15 is provided with a suitable position transducer, e.g. a slide wire potentiometer as indicated at 19, for generating a positional feedback signal. The feedback signal is provided to microprocessor servo control electronics designated generally by reference character 21. The functioning of the control electronic is described in greater detail hereinafter. However, at this point it is useful to note that the control electronics respond to the value of the feedback signal relative to an externally provided reference or set point signal, provided as indicated at reference character 22.

Air or other gas under pressure is provided to the system through a supply line 23 from a suitable source, e.g. a compressor or tank of compressed gas. The flow of gas from the supply is controlled by a simple ON/-OFF solenoid valve 25. The section of conduit downstream of the solenoid valve 25 can also be selectively vented to the atmosphere through a second solenoid-operated valve 26 or can be selectively connected to the actuator cylinder through a third solenoid valve 27.

As indicated previously, charging and discharging of the actuator cylinder is effected through an intermediate chamber of defined size. As is described in greater detail hereinafter, this volume is utilized to control the amount of gas which is admitted or withdrawn from the actuator cylinder in a single step within an overall stepwise mode of operation. Accordingly, this volume is referred to herein as the step volume. With reference to FIG. 1, the chamber defining the step volume is illustrated as a small container or tank 31. As will be understood, the effective step volume includes not only the chamber itself but also the associated connecting passageways. In some embodiments, connecting passages may constitute essentially the entire step volume with no distinct tank or chamber being evident.

Figure 2:
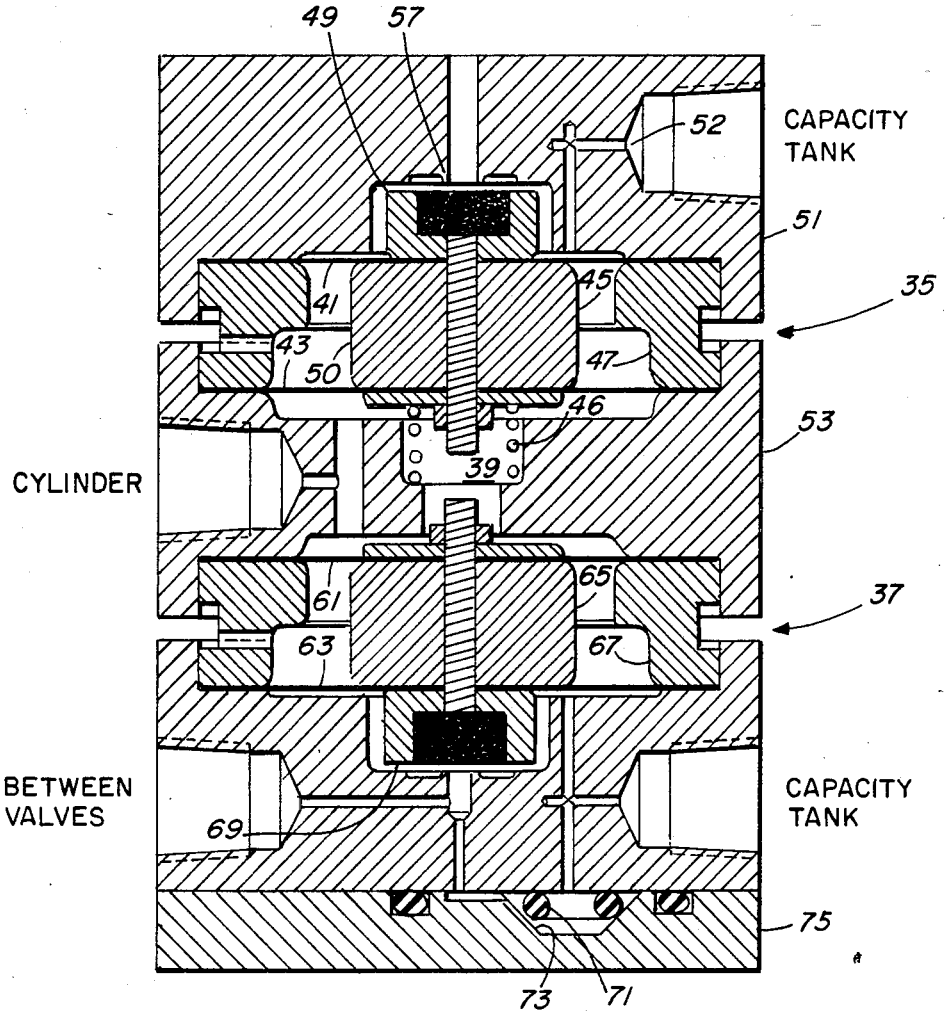
FIG. 2 is a cross-sectional view of a dual differential pressure regulator employed in the apparatus of FIG. 1.

As also indicated previously, the charging and discharging of the step volume is controlled, by a dual differential pressure regulator, designated generally by reference character 32, to regulate or limit the pressure in the step volume as a predetermined function of the then extant pressure in the actuator. The construction of a dual differential pressure regulator suitable for performing these functions is illustrated in FIG. 2.

The two regulator sections, designated generally by reference characters 35 and 37, are of similar, though not identical, construction and are arranged in back-toback fashion, as illustrated, with a common chamber 39 between them. Chamber 39 is connected directly to the actuator 11. This arrangement is appropriate since, as noted previously, each regulator operates to achieve a pressure in the tank 31, which is a function of the pressure in the actuator cylinder.

Each regulator section comprises a pair of diaphragms. The proportionality between the regulated pressure and the actuator cylinder pressure is predetermined by the relative sizes of the operating areas of the two diaphragms in the respective regulator section. With reference to the embodiment shown in FIG. 2, the upper regulator section 35 is the one which controls charging of the step volume. The upper diaphragm of regulator section 35 is designated by reference character 41 and has a smaller operative area than the lower diaphragm which is designated by reference character 43. The diaphragms 41 and 43 are separated at their central regions by a cylindrical spacer 45 which moves with the diaphragms in performing the regulating function and, at their periphery, by a ring-like spacer 47 which, with the peripheries is clamped between the upper regulator housing piece 51 and the middle regulator housing piece 53. A valving element 49 is carried by the central regions of the diaphragms 41 and 43, the valving element and a backing plate 48 being held by a bolt 50 which extends through the diaphragms 41 and 43 and the central spacer 45, thus causing the two diaphragms to be linked and to move together. A slight valve closing bias is provided by a spring 46.

The space above the upper diaphragm is connected to the tank 31 through port 52 as indicated while the space below the lower diaphragm is connected to the actuator cylinder as described previously. The space between the two disphragms is vented to atmosphere so as to be neutral in the regulator operation. The valving element 49 cooperates with a seat 57 machined into the upper regulator housing piece 51. The valving element controls venting of the space above the diaphragm 41 to the atmosphere. As may be seen, the spacer ring 47 is machined so that the operative region of the lower diaphragm 43 is larger than the operative region of the upper diaphragm. Thus, the tank pressure at which equilibrium is achieved higher than the pressure in the actuator's cylinder, the proportionality between the pressures being determined by the relative active areas of the upper and lower diaphragms. If the pressure in the tank exceeds the equilibrium pressure, the valving element 49 lifts from the seat 57 venting some of the gas.

The lower regulator section 37 is essentially similar to the upper regulator section 35 except that, in the lower section, the operative area of the diaphragm exposed to the actuator cyclinder pressure is smaller than the active area of the diaphragm exposed to the pressure being regulated, i.e. the pressure in the tank 31. Accordingly, when the lower regulator section is in equilibrium, the regulated pressure in the tank will be smaller than the pressure in the actuator cylinder, the proportionality being determined by the relative active areas of the diaphragms 61 and 63.

The assembly of FIG. 2 also incorporates a check valve which provides the function of the check valve indicated by reference character 29 in FIG. 1. This check valve permits the conduit volume between the various solenoid valves to vent into the tank 31 while preventing flow in the opposite direction. In the construction illustrated in FIG. 2, this check valve is simply implemented by an O-ring 71 which rests in a frustroconical recess 73 in the regulator bottom plate 75.

While the particular servo control algorithms which will be performed by the microprocessor controller 21 will vary in dependence on the particular application and load which the pneumatic actuator is to operate, the following general description will serve to illustrate the mode of operation and advantages of the apparatus of the present invention. As indicated previously, the apparatus of the present invention achieves precision in operation by effecting charging and discharging of the actuator cylinder through an intermediate step volume, the pressure in the step volume in each case being regulated as a respective function of the then extant pressure in the actuator cylinder. In both advancing and retracting the actuator, the pressure in the step volume is established in one phase of operation and the transfer of gas between the step volume and the actuator occurs in a second phase. The overall operation is thus stepwise. In advancing the actuator piston, the valves 25 and 27 are operated in alternation while in retracting the piston the valves 26 and 27 are operated in alternation.

Considering the advancing operation in more detail, it can be seen that, when the supply valve 25 is opened, gas will flow into the tank 31 increasing its pressure until the regulator section 35 reaches balance at which point the valving element 49 is lifted from its seat causing any excess pressure to vent to the atmosphere. As noted previously, the pressure in the tank at this moment will be regulated as a function of the then extant pressure in the actuator. During the next phase of operation, the valve 25 closes and the valve 27 is opened so that gas can flow from the tank into the cylinder. The lower regulator section does not obstruct this flow since the pressure in the tank is higher than that in the actuator.

Since the step volume, defined by the capacity of tank 31 together with the associated conduits, is well defined, an essentially predetermined step movement of the piston 15 is obtained for a given position of the cylinder and for given pressures at the supply and in the capacity tank. Further, since the pressure to which the tank 31 is charged prior to the transfer to the actuator is regulated to a value which is a function of the then extant pressure in the cylinder, the size of the step does not tend to vary as a function of load or spring bias as much as it would if the step volume were merely filled to a pressure which was only related to the supply pressure. In other words, a first order of compensation is obtained which to a considerable extent alleviates for the variable sensitivity of the actuator with the load. It will be understood that in order to get an approximately constant sensitivity throughout the stroke of the actuator, the volume of the capacity tank 31 should be allowed to vary in proportion with the actuator stroke as described hereinafter. However, for actuators of small to medium stroke, such a volume capacity compensation can be disregarded.

A similar but converse mode of operation is obtained when the piston is being retracted. In this case, the valves 26 and 27 are operated alternately. When the valve 26 is opened, gas in the tank 31 is vented to the atmosphere. The extent of venting, however, is controlled by the lower pressure regulator section 37 so that venting is terminated when the pressure in the tank reaches a predetermined proportion of the pressure in the actuator cylinder, the proportionality factor being determined by the relative active areas of the two diaphragms as described previously. In the alternate phase of retracting operation, the valve 26 is closed and the valve 27 is open. With valve 27 open, gas flows from the actuator cylinder into the tank 31. Again, since the capacity of the tank 31 is fixed and the pressure in the tank prior to opening of the valve 27 is regulated to a level which is a function of the pressure in the cylinder, it can be seen that the actual amount of the gas which is withdrawn from the cylinder will vary as a function of load. Again, a first order of compensation is obtained which alleviates for the effects of the compressibility of the gaseous medium, tending to make the size of the steps obtained less dependent on load.

As will be understood, the cycle of alternating operation of the valves can be repeated as needed to bring the piston to the desired position, i.e. a position at which the feedback signal is substantially equal to the set point signal. Again, the rate at which the alternating cycles or steps are repeated is a design parameter which will depend on the particular application and load which the piston is to operate. As indicated previously, the size of the movement which will occur with each step is in part a function of the size of the tank 31 and this also is a design parameter and the choice of value will depend upon the overall application.

While the present invention is directed towards obtaining precise control over the operation of a pneumatic actuator, it will be understood by those skilled in the art that there are liable to be some circumstances in which it is desired to move the piston quickly, i.e. to cover long distances before any precise settling to final position is needed. With the apparatus of the present invention as illustrated in FIG. 1, rapid advancement of the piston may be obtained simply by opening valves 25 and 26 simultaneously thereby bypassing the stepwise mode of operation contemplated by the present invention. Similarly, fast retraction of the piston may be obtained by simultaneously opening valves 26 and 27 to rather directly vent the actuator cylinder to the atmosphere.

Figure 3:
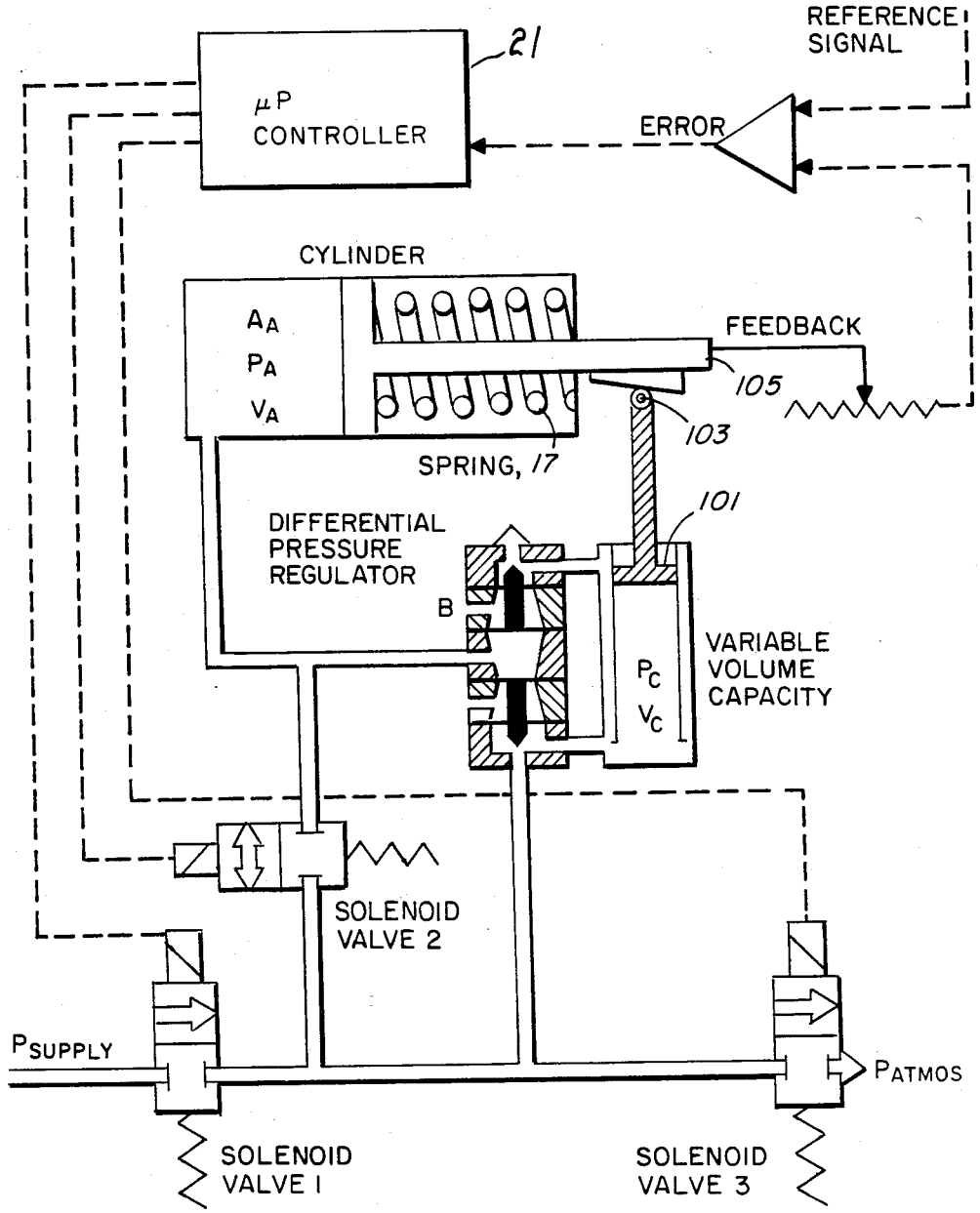

As indicated, the arrangement in FIG. 1 provides compensation for the compressible nature of the gaseous medium being used for operating the actuator by allowing the size of the steps to be compensated by the then extant pressure in the actuator. Another parameter which enters into the effected step size, however, is the active volume in the cylinder for the then extant position of the piston. In the embodiment illustrated in FIG. 3, a further degree of compensation is provided by causing the effective step volume to vary as a function of the position of the actuator piston. With reference to FIG. 3, the step volume may be varied by means of a piston 101. The position of piston 101 is controlled by means of a follower 103 which is driven by means of a ramp or cam 105 which moves with the actuator piston 15. Accordingly, it can be seen that the step volume will vary as a function of actuator position, the step volume growing larger as the air volume in the cylinder grows larger.

Again, the differential pressure regulator provides control of the pressure to which the step volume is charged or discharged as in the previous embodiment but, since the step volume changes as a function of piston position, it can be seen that the amount of gas transferred to or from the actuator cylinder for each step is a function also of piston position. In other words, when the piston is to the left as shown, the amount of gas transferred for each step will be less since the volume in which it will be absorbed or distributed is also less. In this way, a second level of compensation is provided for the compressibility of the gaseous medium utilized to operate the actuator. As with a fixed volume capacity tank, the step size varies with the effective volume of the cylinder the number of steps required to bring the piston to the desired position will vary automatically with the actuator stroke.

In view of the foregoing, it may be seen that several objects of the present invention are achieved and other advantageous results have been attained.

As various changes could be made in the above constructions without departing from the scope of the invention, is should be understood that all matter contained in the above description or shown in the accompanying drawings shall be interpreted as illustrative and not in a limiting sense.

What is claimed is:

1. Apparatus for operating a pneumatic actuator from a source of gas under pressure, said apparatus comprising:

means defining a step volume;

means for selectively charging said step volume from said source;

first pressure regulating means operative during charging to control the pressure in said step volume as a first predetermined function of the then extant pressure in said actuator, said first function providing a step volume pressure which is higher than said then extant pressure;

means for selectively discharging gas from said step volume;

second pressure regulating means for controlling discharging of gas from said step volume to limit the pressure in said step volume as a second predetermined function of the then extant pressure in said actuator, said second function providing a step volume pressure which is lower than said actuator pressure;

means for selectively connecting said step volume to said actuator; and said charging means and said connecting means being operable alternately for advancing said actuator in steps, said discharging means and said connecting means being operable alternately for retracting said actuator in steps.

2. Apparatus as set forth in claim 1 wherein said means for defining a step volume is interconnected with said actuator to cause the step volume to vary as a function of actuator position.

3. Apparatus for operating a pneumatic actuator from a source of gas under pressure, said apparatus comprising:

means defining a step volume;

means for selectively charging said step volume from said source;

first differential pressure regulating means for venting said step volume during charging to limit the pressure therein as a first predetermined function of the pressure in said actuator, said first function providing a step volume pressure which is higher than said actuator pressure;

means for selectively discharging gas from said step volume;

second differential pressure regulating means for controlling discharging of gas from said step volume to limit the pressure in said volume as a second predetermined function of the pressure in said actuator, said second function providing a step volume pressure which is lower than said actuator pressure;

means for selectively connecting said step volume to said actuator; and said charging means and said connecting means being operable alternately for advancing said actuator in controlled steps, said discharging means and said connecting means being operable alternately for retracting said actuator in controlled steps.

4. Apparatus as set forth in claim 3 further comprising a check valve between said step volume and said discharging means.

5. Apparatus for operating a pneumatic actuator from a source of gas under pressure, said apparatus comprising:

means defining a step volume;

means for selectively charging said step volume from said source;

first differential pressure regulating means for venting said step volume during charging to limit the pressure therein as a first predetermined function of the pressure in said actuator, said first function providing a step volume pressure which is higher than said actuator pressure;

means for selectively discharging gas from said step volume;

second differential pressure regulating means for controlling discharging of gas from said step volume to limit the pressure in said volume as a second predetermined function of the pressure in said actuator, said second function providing a step volume pressure which is lower than said actuator pressure;

means for selectively connecting said step volume to said actuator; and means for operating said charging means and said connecting means alternately for advancing said actuator in controlled steps and for operating said discharging means and said connecting means alternately for retracting said actuator in controlled steps.

6. Apparatus as set forth in claim 5 further comprising means interconnected with said actuator for generating a feedback signal, said generating means and said operating means being interconnected to provide servo control of the position of said actuator with respect to an externally provided set point signal.

7. Apparatus for operating a pneumatic actuator from a source of gas under pressure, said apparatus comprising:

means defining a step volume which varies as a function of actuator displacement;

means for selectively charging said step volume from said source;

first differential pressure regulating means for venting said step volume during charging to limit the pressure therein as a first predetermined function of the pressure in said actuator, said first function providing a step volume pressure which is higher than said actuator pressure;

means for selectively discharging gas from said step volume;

second differential pressure regulating means for controlling discharging of gas from said step volume to limit the pressure in said volume as a second predetermined function of the pressure in said actuator, said second function providing a step volume pressure which is lower than said actuator pressure;

means for selectively connecting said step volume to said actuator; and said charging means and said connecting means being operable alternately for advancing said actuator in controlled steps, said discharging means and said connecting means being operable alternately for retracting said actuator in controlled steps.

* * * * *